United States Patent [19]

Takeuchi

[11] Patent Number: 4,945,972

[45] Date of Patent: Aug. 7, 1990

[54] CONTAINABLE DOOR OF FOLDING TYPE

[75] Inventor: Katsuyuki Takeuchi, Osaka, Japan

[73] Assignee: NEC Home Electronics Ltd., Osaka, Japan

[21] Appl. No.: 399,587

[22] Filed: Aug. 28, 1989

[30] Foreign Application Priority Data

Aug. 31, 1988 [JP] Japan ..... 63-217694

[51] Int. Cl.[5] ..... E05D 15/26

[52] U.S. Cl. ..... 160/203; 49/257; 312/322; 160/210

[58] Field of Search ..... 312/322, 110, 350, 109; 49/254, 257, 261, 223, 197; 160/185, 203, 198, 204, 213, 201, 210, 196 R

[56] References Cited

U.S. PATENT DOCUMENTS

| | | | |
|---|---|---|---|
| 4,219,006 | 8/1980 | Nesje | 49/257 |
| 4,591,214 | 5/1986 | Reuter et al. | 49/257 |
| 4,610,291 | 9/1986 | Carroll | 160/213 |

FOREIGN PATENT DOCUMENTS

| | | | |
|---|---|---|---|
| 0329353 | 9/1935 | Italy | 312/322 |
| 0023325 | 8/1898 | United Kingdom | 312/322 |

*Primary Examiner*—Kenneth J. Dorner

*Assistant Examiner*—Gerald A. Anderson

*Attorney, Agent, or Firm*—Cushman, Darby & Cushman

[57] ABSTRACT

A folding door, containable in a cabinet, includes a door body foldable outwardly of the cabinet. A slide member is slidable along an inner surface of the cabinet toward and away from a front of the cabinet. The door body is angularly movably connected at its proximal end portion to the slide member by a hinge. A lock member is mounted on the proximal end portion of the door body so as to be angularly movable about an axis disposed at a central portion of the lock member. The lock member has an engaging portion extending obliquely toward the inner surface of the cabinet, and a contact portion extending toward the distal end of the door body. A urging member urges the lock member to be angularly moved in a direction to abut the engaging portion against the inner surface of the cabinet. A retainer member is provided on the inner surface of the cabinet for retaining the engaging portion of the lock member. When the door body is folded, a urging surface on the door body is engaged with the contact portion so as to angularly move the lock member in a direction to move the engaging portion away from the inner surface of the cabinet.

5 Claims, 3 Drawing Sheets

CONTAINABLE DOOR OF FOLDING TYPE

FIELD OF THE INVENTION

The present invention relates generally to a containable door of the folding type which can be contained or received within a case box or cabinet, and more particularly to such a door provided with a containing and lock mechanism for preventing a door body from being moved into the cabinet when the door body is not completely folded.

BACKGROUND OF THE INVENTION

FIG. 1 shows a conventional containable door of such a type, which is disclosed in an Unexamined Japanese Utility Model Application No. 62-75183. More specifically, a cabinet for a projection television set includes a pair of containable, folding doors (only one of which is shown) which can open away from each other. The pair of doors includes respective bodies 2 for covering the screen of the television set. The door body 2 comprises a pair of door panels 4 and 5 connected together by a hinge 3 so that the door body 2 can be folded. The door panel 4 is disposed adjacent to a side wall 1 of the cabinet whereas the door panel 5 is disposed adjacent to one end of the door panel 4 remote from the side wall 1. The other end of the door panel 4 is angularly movably connected to a slide member 8 through first and second metal hinge elements 6 and 7. A metal slide element 9 fixedly secured to the slide member 8 is engaged with a rail 10 for sliding movement therealong. The rail 10 is fixedly mounted on the side wall 1 and extending rearwardly from a position adjacent to the front of the cabinet. The first and second hinge elements 6 and 7 are pivotally connected together by a pivot pin 11, and a lock member 12 is also pivotally mounted on the pivot pin 11 and is interposed between the first and second hinge elements 6 and 7. The lock member 12 is urged in a clockwise direction (FIG. 1) by a torsion spring 13 acting between a projection 12*a* of the lock member 12 and the second hinge element 7.

In the closed condition (solid line in FIG. 1) of the door, the lock member 12 is engaged with a stopper or projection 14, formed on the side wall 1, to thereby prevent the slide member 8 from moving rearward or backward. When the door is folded to be opened as shown in phantom in FIG. 1, an upwardly-directed projection 6*a* formed on the first hinge element 6 is brought into engagement with a shoulder or stepped portion 12*b* of the lock member 12 to urge the lock member 12 to angularly move in a counterclockwise direction. As a result, the lock member 12 is disengaged from the stopper 14, so that the slide member 8 and the folded door body 2 connected to the slide member 8 can be slidably moved in a direction of an arrow A (FIG. 1) so as to be contained in the cabinet.

In this conventional containable door having a lock mechanism, the projection 6*a*, formed on the first hinge 6 connected to the door body 2, is adapted to be engaged with the stepped portion 12*b* of the lock member 12 to release the locking condition. In other words, such lock release depends on the angle of opening of the door (more specifically, the angle of opening of the door panel 4). Therefore, the timing of the lock release is not clear, and there is a risk that the locking is released even when the door body 2 is not fully folded, so that the slide member 8 and the door body 2 can move into the cabinet. Thus, the timing of the lock release cannot be controlled.

SUMMARY OF THE INVENTION

It is therefore an object of the present invention to provide a containable, folding door of the type in which the timing of releasing the locking of a door body can be accurately controlled, thereby preventing the door body from being accidentally moved to be contained in a cabinet.

The above and other objects can be achieved by a provision of a containable door which, according to the present invention, comprises:

(a) a door body foldable outwardly of the cabinet, the door body having an urging surface on its inner face adjacent to its distal end;

(b) a slide member slidable along an inner surface of the cabinet toward and away from a front of the cabinet, the door body being angularly movably connected at its proximal end portion to the slide member by a hinge;

(c) a lock member mounted on the proximal end portion of the door body so as to be angularly movable about an axis disposed at a central portion of the lock member, the lock member having an engaging portion extending obliquely toward the inner surface of the cabinet, the lock member also having a contact portion extending toward the distal end of the door body;

(d) means for urging the lock member to be angularly moved in a direction to abut the engaging portion against the inner surface of the cabinet; and (e) means provided on the inner surface of the cabinet for retaining the engaging portion of the lock member;

(f) when the door body is folded, the urging surface being engaged with the contact portion so as to angularly move the lock member in a direction to move the engaging portion away from the inner surface of the cabinet.

With this construction, when the door is folded to be opened, the distal end of the door body is moved toward the proximal end of the door body, and the urging surface of the door body is brought into contact with the contact portion of the lock member to urge the lock member to be angularly moved in a direction to move the engaging portion away from the inner surface of the cabinet. As a result, the engaging portion of the lock member is disengaged from the retaining means, so that the slide member and the door body connected thereto can be moved into the cabinet so as to be contained therein.

DESCRIPTION OF THE PREFERRED EMBODIMENT

Figure 1:
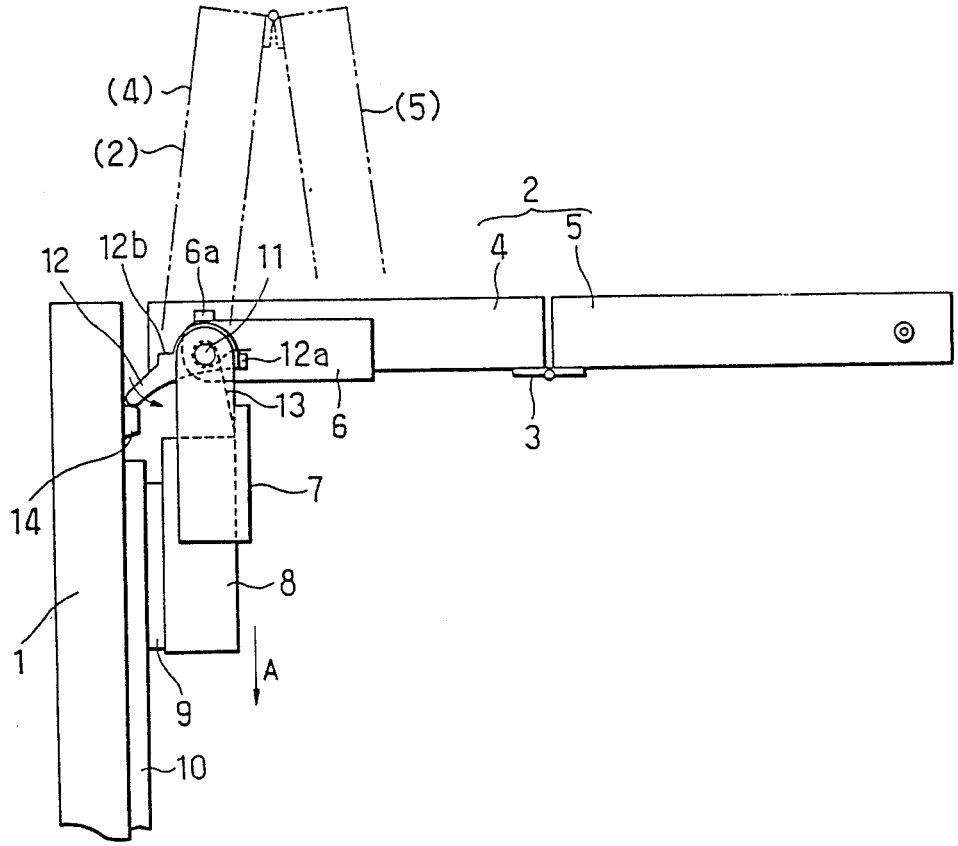
FIG. 1 is a top plan view of a portion of a cabinet having a convention containable door of the folding type.

The present invention will now be described in detail with reference to accompanying drawings. In the drawings, like parts and components are designated by the same reference numerals.

Figure 2:
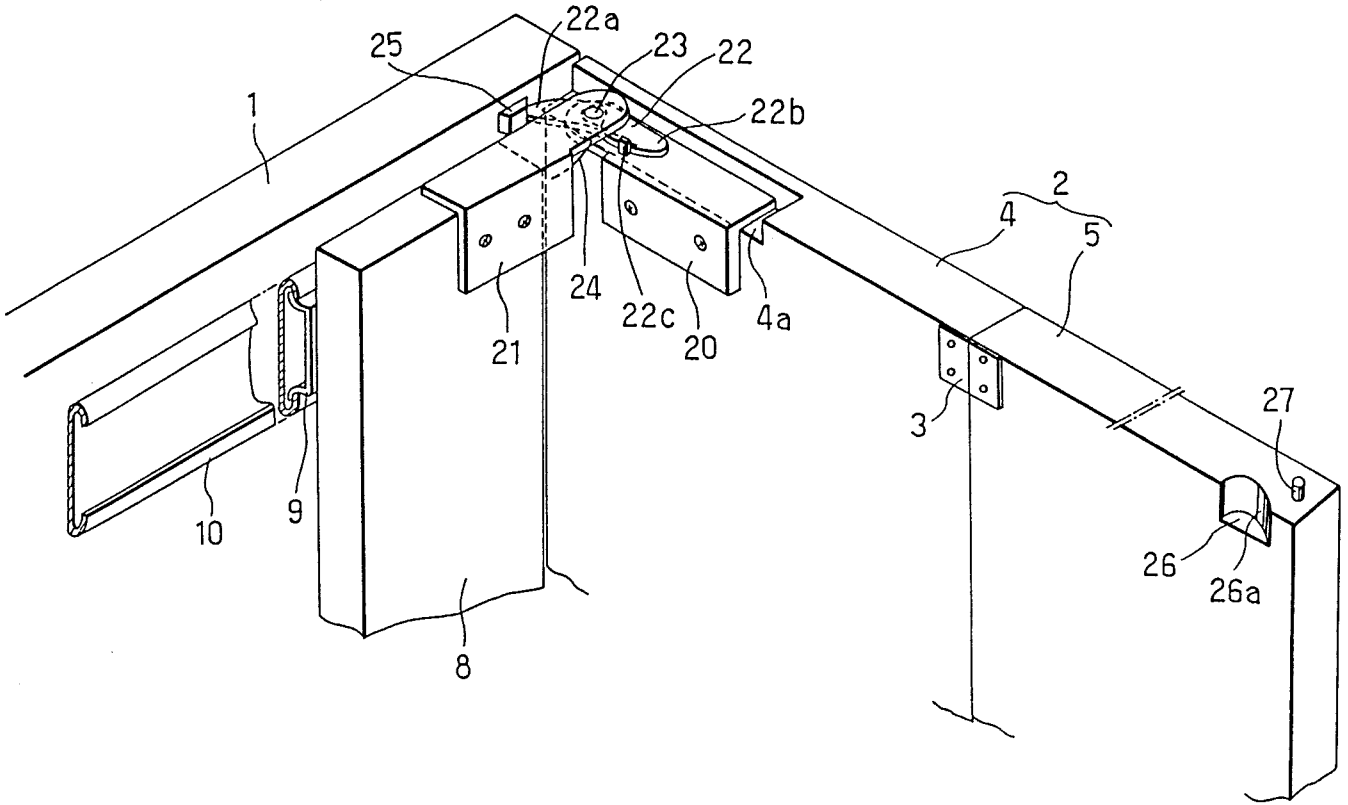
FIG. 2 is a perspective view of a portion of a cabinet having a containable door of the folding type provided according to the present invention, showing the door in its closed condition.

FIG. 2 shows a portion of a cabinet for containing a projection television set. The cabinet comprises a pair of containable, folding doors (only one of which is shown in the drawings) which can be opened away from each other. The pair of doors include respective bodies 2 for covering the screen of the television set. The door body 2 comprises a pair of door panels 4 and 5 connected together by a hinge 3 so that the door body 2 can be folded.

A slide member 8, which is in the form of a plate and is generally coextensive in height with the door body 2, has a pair of upper and lower metal slide elements 9 (only upper one of which is shown) fixedly secured thereto. A pair of upper and lower rails 10 (only upper one of which is shown) are fixedly mounted on an inner surface of a side wall 1 of the cabinet and extend horizontally rearwardly from a position adjacent to the front of the cabinet. The upper and lower slide members 9 are engaged respectively with the upper and lower rails 10 for sliding movement therealong.

The door body 2 is angularly movably connected at its proximal end (i.e., one end of the door panel 4) to the slide member 8 through first and second hinge elements 20 and 21. More specifically, the first hinge element 20 of an L-shaped cross-section defined by a pair of legs is fixedly secured to the door panel 4, with one leg thereof received in a recess 4*a* formed in the upper end surface of the door panel 4. The second hinge element 21 of an L-shaped cross-section defined by a pair of legs is fixedly secured to the upper end of the slide member 8.

Figure 3:
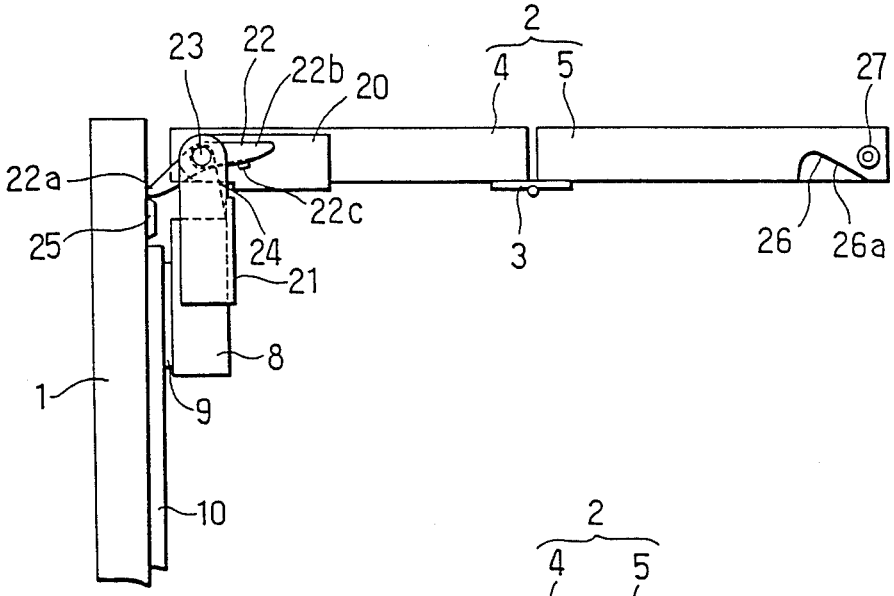
FIG. 3 is a top plan view of the portion of the cabinet of FIG. 2.

A lock member 22 of a generally V-shape is interposed between the first and second hinge elements 20 and 21, and has an engaging portion 22*a* extending obliquely toward the side wall 1 of the cabinet. The lock member 22 also has a contact portion 22*b* extending toward the distal end of the door body 2. The first and second hinge elements 20 and 21 and the lock member 22 are mounted on a common pivot pin 23, mounted on the door panel 4, so that they are angularly movable relative to one another. A torsion spring 24 is mounted on the pivot pin 23, and urges the lock member 22 to angularly move the same in a clockwise direction (FIGS. 3 and 4) so as to press the distal end of the engaging portion 22*a* of the lock member 22 against the side wall 1. More specifically, the one end of the torsion spring 24 is engaged with an upwardly-directed projection 22*c* formed on the lock member 22 whereas the other end of the torsion spring 24 is engaged with the inner side of the lower leg of the second hinge element 21. A stopper or projection 25 of a trapezoidal shape is formed on the inner surface of the side wall 1 of the cabinet, and the distal end of the engaging portion 22*a* of the lock member 22 is engageable with the stopper 25. The stopper 25 acts as a retaining means for retaining the engaging portion 22*a* of the lock member 22 until the door body is fully opened.

A notch 26 is formed in the upper end surface of the door panel 5 adjacent to its distal end. The notch 26 opens to the inner face of the door panel 5 and has an inclined urging surface 26*a*. When the door is being folded, the urging surface 26*a* is brought into contact with the contact portion 22*b* of the lock member 22 to urge the lock member 22 to angularly move in a direction away from the side wall 1, that is, in a counterclockwise direction in FIGS. 3 and 4. A projection 27 is slidably received in a guide groove, formed in an inner surface of an upper wall (not shown) of the cabinet adjacent a front opening of the cabinet and extending in a direction perpendicular to the side wall 1.

The operation of the door will now be described.

In the closed condition of the door body 2 (FIGS. 2 and 3), the lock member 22 is urged in a clockwise direction (FIG. 3) against the side wall 1 by the torsion spring 24, and is held in contact with the stopper 25 formed on the side wall 1 to thereby prevent the door body 2 from moving into the cabinet.

For opening the door body 2, the door body 2 is folded. During this folding operation, since the projection 27 slidably moves along the guide groove (not shown) in the upper wall of the cabinet, the distal end of the door body 2 moves toward its proximal end in the plane of the front opening of the cabinet so that the mid portion of the door body 2 is projected outwardly of the cabinet. As the distal end of the door body 2 approaches its proximal end, the urging surface 26*a* on the distal end portion of the door body 2 is brought into contact with the contact portion 22*b* of the lock member 22 disposed at the proximal end of the door body 2 immediately before the door body 2 is fully opened, so that the urging surface 26*a* urges the contact portion 22*b*. As a result, the lock member 22 is angularly moved by the urging surface 26*a* in a counterclockwise direction (FIG. 4) to move the engaging portion 22*a* away from the side wall 1 of the cabinet. As a result, the engaging portion 22*a* of the lock member 22 is disengaged from the stopper 25 formed on the side wall 1 of the cabinet, so that the slide member 8 and the folded door body 2 can move along the rails 10 to be contained in the cabinet.

Figure 4:
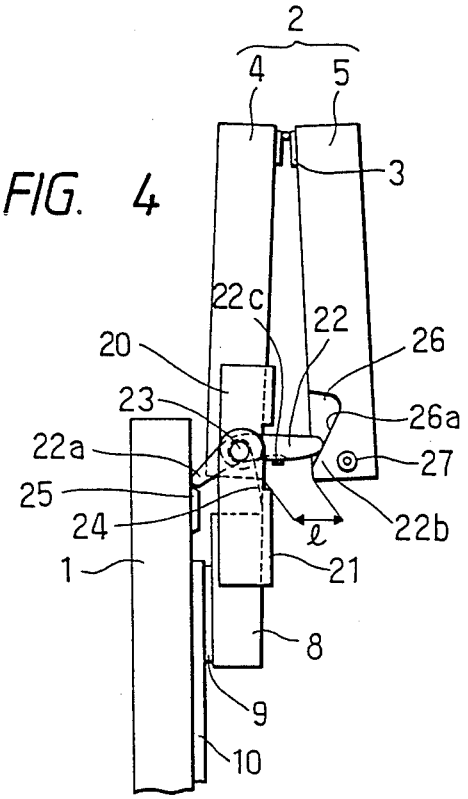
FIG. 4 a view similar to FIG. 3, but showing the door in its open condition.

FIG. 4 shows the condition in which the lock member 22 is just to be angularly moved in a counterclockwise direction, and when a distance M between the proximal end of the door panel 4 and the distal end of the door panel 5 becomes a predetermined value, the locking is released. In other words, when this distance M is greater than the predetermined value, the locking is positively maintained, thus preventing the door body 2 from accidentally moving into the cabinet. Thus, the timing of the lock release is determined by the distance or spacing between the proximal and distal ends of the folded door body 2, and therefore this timing is clear and can be controlled accurately.

In the above embodiment, although the urging surface 26*a* is defined by the inclined surface of the notch or recess, the urging surface may be flat by suitably modifying the shape of the lock member, and also the urging surface may be defined by an inclined surface of a convex portion.

Also, in the above embodiment, although the projecting stopper 25 for retaining the lock member 22 is provided on the side wall 1 of the cabinet, the stopper 25 may be replaced by a stopper formed on the upper wall of the cabinet, in which case an upwardly-directed projection is formed on the distal end of the engaging portion 22*a* of the lock member 22 so as to engage with such a modified stopper. In short, any type of retaining means can be used so long as it can retain the engaging portion 22*a* of the lock member 22 except when the door body 2 is urged by the urging surface 26 to be angularly moved.

Further, in the above embodiment, although the lock member 22 is mounted utilizing the pivot pin 23 connecting the first and second hinge elements 20 and 21 together, the lock member 22 can be mounted independently of these hinge elements connecting the door body 2 and the slide member 8 together. More specifically, the hinge elements may be disposed at a level or height intermediate the upper and lower ends of the door body 2, and alternatively the lock member may be disposed at a level intermediate the upper and lower ends of the door body 2. In the case where such components are disposed intermediate the upper and lower ends of the door body 2, the door body 2 is suitably notched if necessary.

Further, in the above embodiment, although there are provided the pair of folding doors which can open away from each other, a single door which can be opened in one direction may be used.

As described above, the present invention provides the following advantages.

Before the door body is fully folded, the door body is positively prevented from moving into the cabinet to be contained therein.

Moreover, since the timing of the lock release is determined by the distance between the proximal and distal ends of the folded door body, the timing of the lock release is clear, and this timing can be accurately controlled.

What is claimed is:

1. A folding door containable in a cabinet, comprising:

a foldable door body, said door body having an urging surface on its inner face adjacent to its distal end;

a slide member slidable along an inner surface of the cabinet toward and away from a front side thereof, said door body being angularly movably connected at its proximal end portion to said slide member by a hinge;

a lock member mounted on the proximal end portion of said door body so as to be angularly movable about an axis disposed at a central portion of said lock member, said lock member having an engaging portion extending obliquely toward the inner surface of the cabinet, said lock member also having a contact portion extending toward the distal end of said door body;

means for urging said lock member to be angularly moved in a direction to abut said engaging portion against the inner surface of the cabinet; and means for retaining said engaging portion of said lock member, said retaining means being provided on the inner surface of the cabinet, wherein when said door body is folded, said urging surface of said door body is engaged with said contact portion of said lock member so as to angularly move said lock member in a direction to move said engaging portion away from the inner surface of the cabinet.

2. A folding door according to claim 1, wherein said lock member is mounted on a pivot pin of said hinge.

3. A folding door according to claim 2, wherein said urging means comprises a torsion spring mounted on said pivot pin.

4. A folding door according to claim 1, wherein said urging surface is defined by a surface of a notch formed in the inner face of said door body adjacent to its distal end.

5. A folding door according to claim wherein said retaining means is defined by a projection formed on the inner surface of the cabinet.

* * * * *